US009716340B2

(12) United States Patent
Suzuki

(10) Patent No.: US 9,716,340 B2
(45) Date of Patent: Jul. 25, 2017

(54) CONNECTOR

(71) Applicant: Sumitomo Wiring Systems, Ltd., Yokkaichi, Mie (JP)

(72) Inventor: Masakazu Suzuki, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/276,857

(22) Filed: Sep. 27, 2016

(65) Prior Publication Data

US 2017/0098909 A1 Apr. 6, 2017

(30) Foreign Application Priority Data

Oct. 5, 2015 (JP) ..... 2015-197477

(51) Int. Cl.
*H01R 13/62* (2006.01)
*H01R 13/629* (2006.01)
*H01R 13/642* (2006.01)

(52) U.S. Cl.
CPC ..... *H01R 13/62911* (2013.01); *H01R 13/642* (2013.01)

(58) Field of Classification Search
CPC ..... H01R 13/62938; H01R 13/629; H01R 13/631; H01R 13/62933
USPC ..... 439/157, 376, 374, 372
See application file for complete search history.

(56) References Cited

U.S. PATENT DOCUMENTS 5,641,293 A * 6/1997 Tsuji ..... H01R 13/62905 439/157
5,727,959 A * 3/1998 Yagi ..... H01R 13/62955 439/157
7,963,781 B2 * 6/2011 Takahashi ..... H01R 13/629 439/157
2014/0242819 A1 8/2014 Suzuki

FOREIGN PATENT DOCUMENTS

JP 2014-165031 9/2014

* cited by examiner

*Primary Examiner* — Phuongchi T Nguyen
(74) *Attorney, Agent, or Firm* — Gerald E. Hespos; Michael J. Porco; Matthew T. Hespos

(57) ABSTRACT

A connector is such that a first housing (10) is provided with a slider (21) formed with two cam grooves (24), a second housing (30) is formed with two cam followers (36) and contact edges (27) are formed at entrances (24E) of the cam grooves (24). An outer peripheral surface of the cam follower (36) has a substantially semicircular surface (41) on a rear side in an entering direction into the cam groove (24). A receiving surface (44) extending in the same direction as the entering direction into the cam groove (24) from an end part of the substantially semicircular surface (41) facing the contact edge part (27) is formed on the outer peripheral surface of the cam follower (36), and at a right angle or at an angle α smaller than a right angle to a sliding direction of the slider (21).

6 Claims, 12 Drawing Sheets

CONNECTOR

BACKGROUND

1. Field of the Invention

The present invention relates to a connector.

2. Description of the Related Art

Japanese Unexamined Patent Publication No. 2014-165031 discloses a connector configured so that a slider formed with two cam grooves is provided in a first housing slidably between an initial position and a connection position and a second housing connectable to the first housing is formed with two cam followers. In connecting the housings, the cam followers enter the entrances of the cam grooves with the slider located at the initial position and, in that state, the slider is slid to the connection position. Then, the two housings are pulled toward each other to be connected by the engagement of the cam followers and the cam grooves.

If the two housings are inclined even slightly during the connecting operation, the slider may be slid without one cam follower properly entering the cam groove. In this case, the cam follower that has entered the cam groove properly is guided toward a back side of the cam groove, whereas the cam follower that has not entered the cam groove properly is pushed out of the cam groove. Thus, the second housing, the slider and the like may be broken.

The invention was completed based on the above situation and aims to enable a movement of a slider to be restricted when the slider and a pair of cam followers is in an improper positional relationship.

SUMMARY

The invention relates to a connector with a first housing and a second housing connectable to the first housing. A slider is provided in the first housing and is slidable in a direction intersecting a connecting direction of the two housings between an initial position where the slider waits when the housings are not connected yet and a connection position where the two housings are brought to a properly connected state. Two cam grooves are formed on the slider and are arranged at a distance from each other in a sliding direction of the slider. Two cam followers are formed on the second housing and are configured to enter the cam grooves with the slider at the initial position and the two housings held proximate to each other. A contact edge constitutes an opening edge of the cam groove and is capable of contacting an outer peripheral surface of the cam follower in the same direction as the sliding direction from the initial position to the connection position. A substantially semicircular surface constitutes a substantially semicircular region on a rear side in an entering direction into the cam groove, and a receiving surface constitutes the outer peripheral surface of the cam follower and extends in the same direction as the entering direction into the cam groove from an end part facing the contact edge. The receiving surface is at a right angle or at an angle smaller than a right angle to the sliding direction of the slider.

Note that the substantially semicircular surface is defined to be either a semicircular surface having a constant curvature or a substantially semicircular surface although a curvature is slightly non-uniform.

The receiving surface may be connected tangentially to the end part of the substantially semicircular surface. The technical significance of this configuration is as follows. If a boundary part between the substantially semicircular surface and the receiving surface has a complicated shape such as a stepped shape, a stress may concentrate on the boundary part between the substantially semicircular surface and the receiving surface when the outer peripheral surface of the cam follower receives a pressing force from an inner side surface side of the cam groove. However, if the receiving surface is connected tangentially to the end part of the substantially semicircular surface, a stress concentration on the boundary part between the substantially semicircular surface and the receiving surface can be avoided.

More particularly, the outer peripheral surface of the cam follower may have a substantially quarter-circular surface extending from an end part not facing the contact edge part and a linking surface extending substantially parallel to the sliding direction of the slider from an extending end part of the substantially quarter-circular surface to an extending end part of the receiving surface.

The extending end part of the receiving surface and an extending end part of the linking surface may be connected via an arcuate surface.

According to the above, if an attempt is made to slide the slider from the initial position to the connection position without one cam follower properly entering the entrance of the respective cam groove, the contact edge part butts against the receiving surface. Here, since the receiving surface is at a right angle or at an angle smaller than a right angle to the sliding direction of the slider, even if the contact edge part strongly presses the receiving surface, there is no possibility that the cam follower is pushed out of the cam groove. Thus, there is no possibility that the slider is slid toward the connection position with the one cam follower pushed out of the cam groove, i.e. with the slider and the pair of cam followers held in an improper positional relationship.

These and other objects, features and advantages of the invention will become more apparent upon reading the following detailed description and accompanying drawings. It should be understood that even though embodiments are described separately single features thereof may be combined to additional embodiments.

DETAILED DESCRIPTION

A first embodiment of the present invention is described with reference to FIGS. 1 to 10. A connector of this first embodiment includes a first housing 10, a booster mechanism 20 and a second housing 30. It should be understood that respective mating sides of the first housing 10 and the second housing 20 are referred to as a front or front side.

Figure 1:
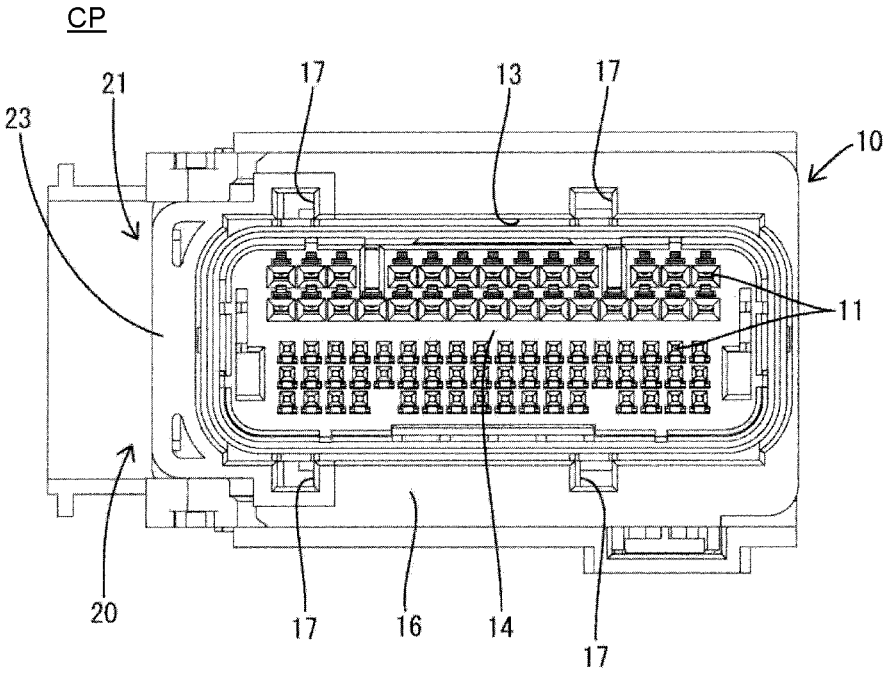
FIG. 1 is a front view of a first housing of a first embodiment.
Figure 2:
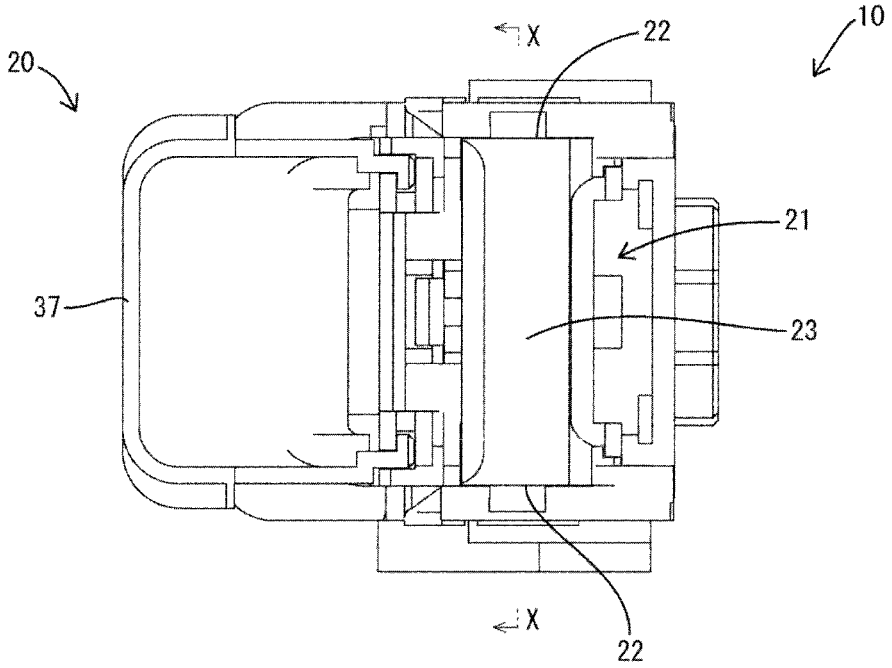
FIG. 2 is a side view of the first housing.
Figure 3:
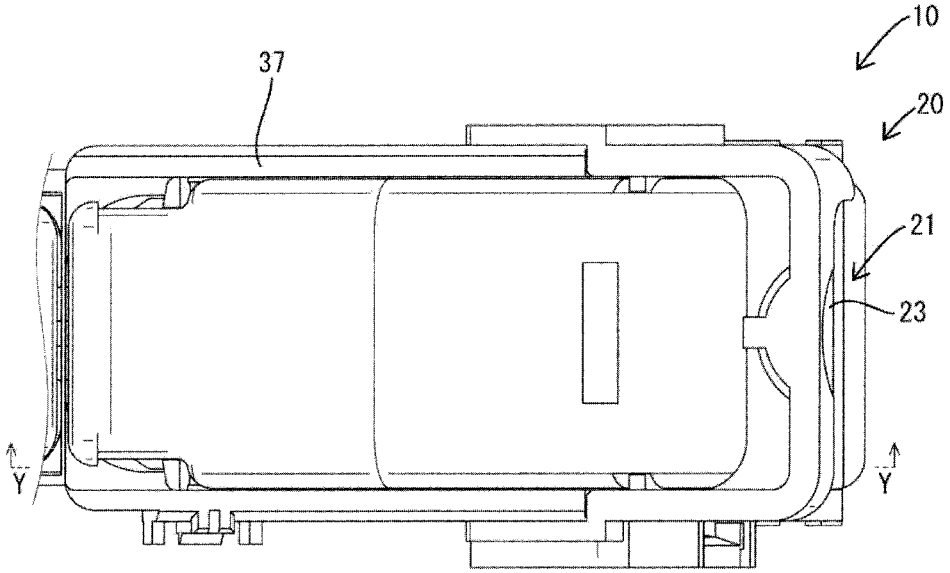
FIG. 3 is a rear view of the first housing.
Figure 6:
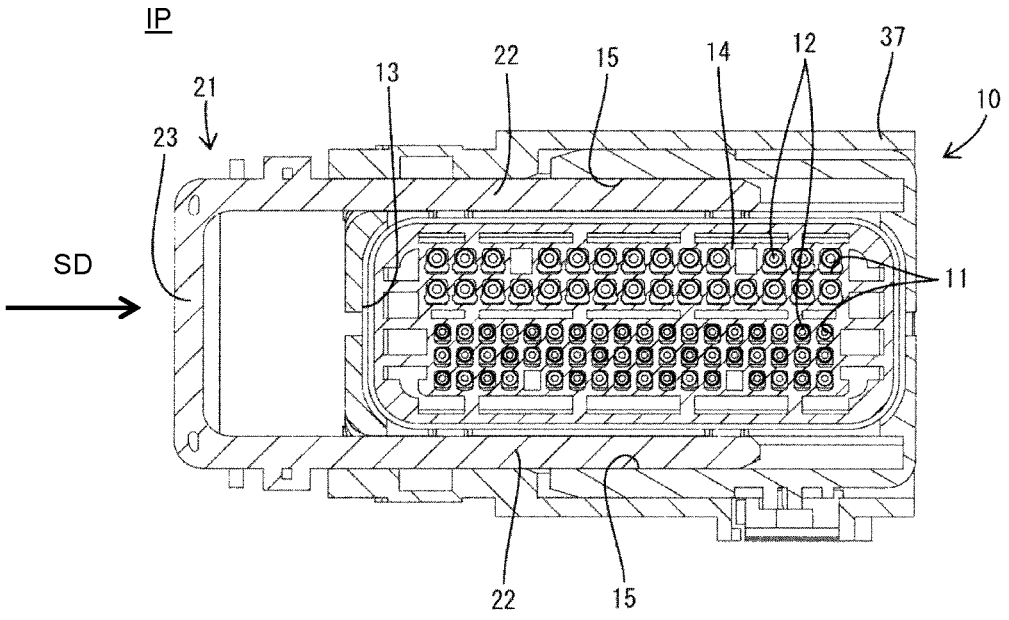
FIG. 6 is a section corresponding to a cross-section along X-X of FIG. 2 showing a state where a slider is at an initial position.
Figure 7:
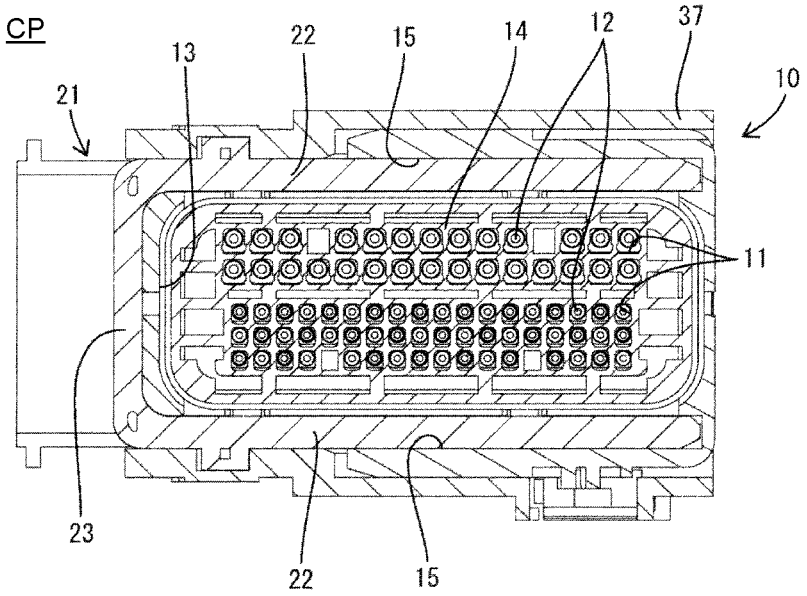
FIG. 7 is a section corresponding to a cross-section along X-X of FIG. 2 showing a state where the slider is at a connection position.

The first housing 10 is made e.g. of synthetic resin and, as shown in FIGS. 1, 6 and 7, terminal accommodating chambers 11 are formed in the first housing 10 and are open on the front surface of the first housing 10. A female terminal fitting 12 of a known form is accommodated in each terminal accommodating chamber 11. A forwardly open fitting recess 13 is formed in the first housing 10. The fitting recess 13 is arranged to collectively surround a substantially block-like terminal accommodating portion 14 formed with the terminal accommodating chambers 11. An opening shape of the fitting recess 13 (i.e. an outer peripheral surface of the terminal accommodating portion 14) on the front surface of the first housing 10 is a wide substantially rectangular shape.

As shown in FIGS. 6 to 9, upper and lower guide spaces 15 are formed in the first housing 10 and define laterally long slits that are open on side surfaces of the first housing 10. The guide spaces 15 function as a guide means for sliding a slider 21 in a lateral direction between an initial position and a connection position. The two guide spaces 15 extend long in the lateral direction and communicate with the upper and lower surfaces of the fitting recess 13. Further, two pairs of communication holes 17 open on the front surface of the first housing 10 are formed on front surface walls 16 constituting the guide spaces 15 and communicating with the upper and lower guide spaces 15. The paired communication holes 17 are arranged at a predetermined distance from each other in the lateral direction.

The slider 21 is a component constituting the booster mechanism 20 and is made of synthetic resin. As shown in FIGS. 6 and 7, the slider 21 is a single component including upper and lower cam functioning portions 22 in the form of flat plates and a plate-like operating portion 23 coupling end parts of the cam functioning portions 22. The upper and lower cam functioning portions 22 are respectively fit into the guide spaces 15 slidably in the lateral direction. The slider 21 slides in the lateral direction between the initial position shown IP in FIGS. 6, 8 and 9 and the connection position shown in FIGS. 1 and 7 by the fitting of the cam functioning portions 22 and the guide spaces 15.

Figure 8:
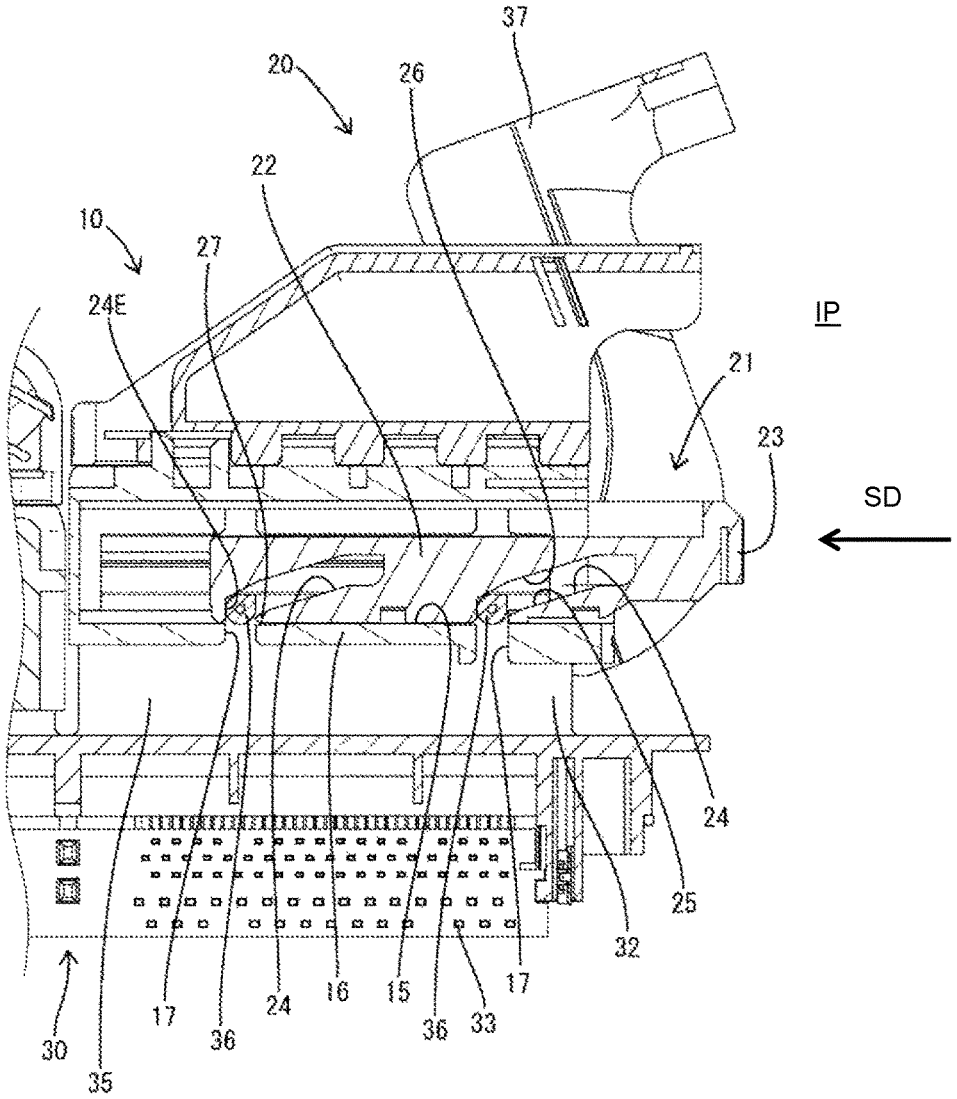
FIG. 8 is a section corresponding to a cross-section along Y-Y of FIG. 3 showing a state where both of paired cam followers are properly inserted in the entrances of cam grooves.
Figure 9:
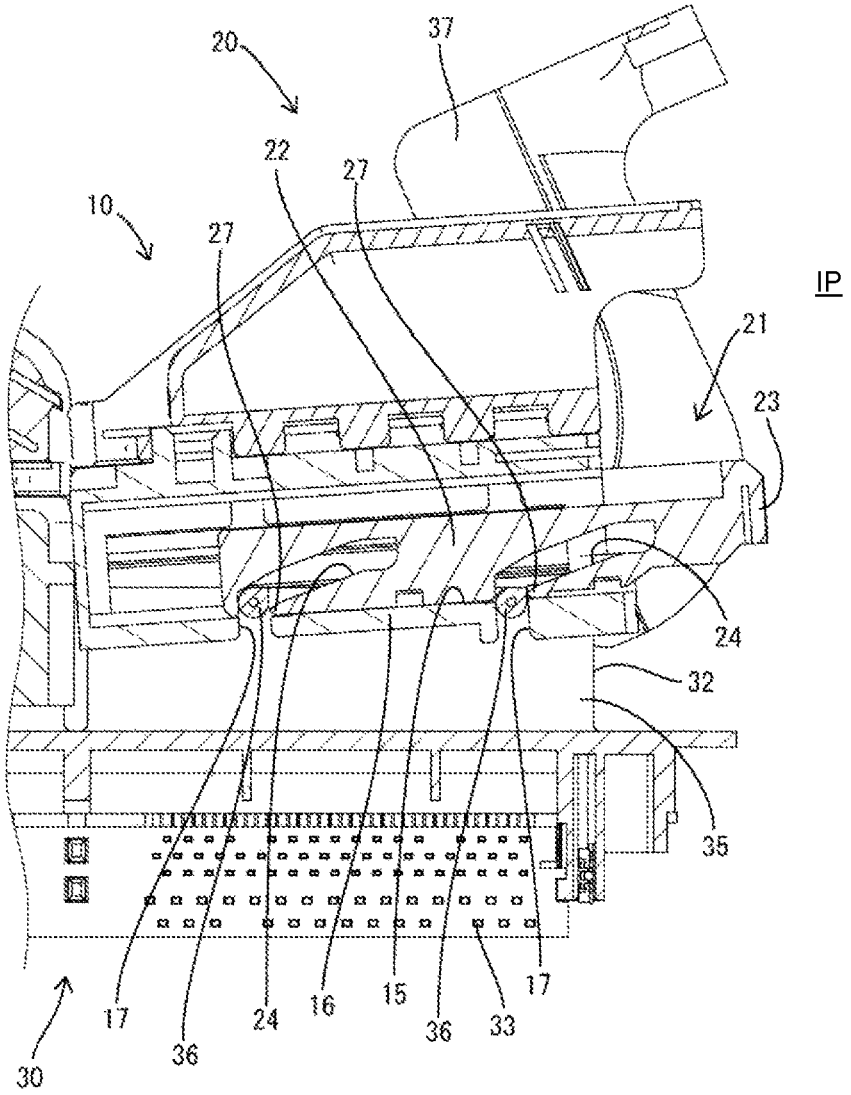
FIG. 9 is a section corresponding to a cross-section along Y-Y of FIG. 3 showing a state where one of the pair of cam followers is properly inserted in the entrance of the cam groove and the other cam follower is not properly inserted in the entrance of the cam groove.

As shown in FIGS. 8 and 9, each cam functioning portion 22 is formed with two cam grooves 24 spaced apart in the lateral direction. In a plan view, each cam groove 24 extends oblique to a sliding direction of the slider 21. In the plan view, an inner surface on a front side (lower side in FIGS. 8 and 10) of the cam groove 24 defines a connection cam surface 25 that exhibits a cam function in connecting the two housings 10, 30. In the plan view, an inner surface on a rear side (upper side in FIGS. 8 and 10) of the cam groove 24 defines a separation cam surface 26 that exhibits a cam function in separating the housings 10, 30.

Figure 10:
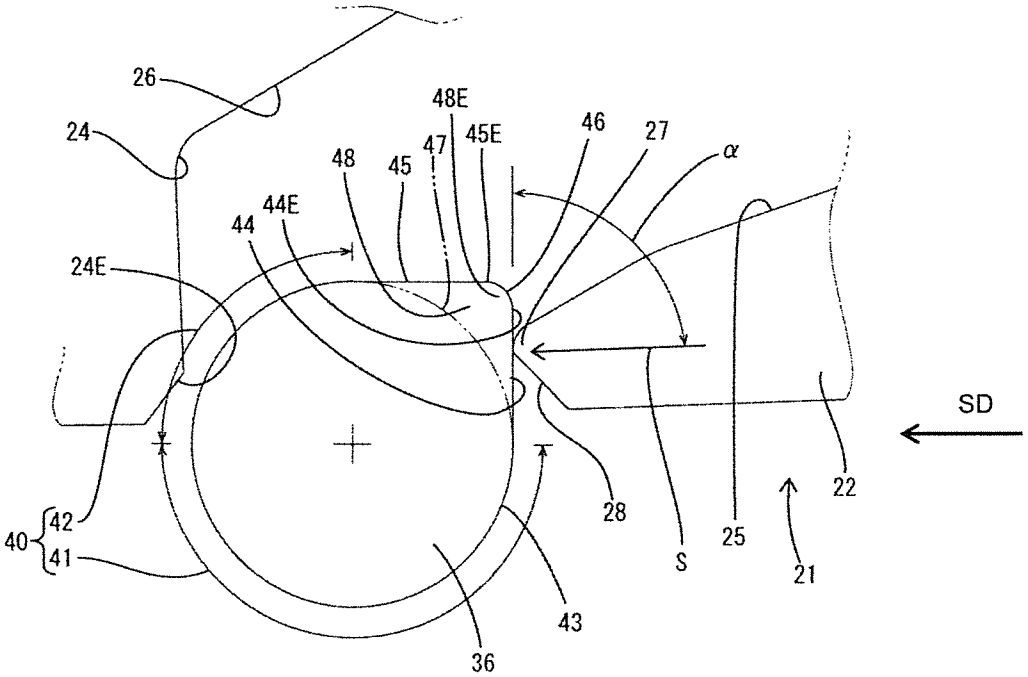
FIG. 10 is an enlarged plan view showing an outer peripheral shape of the cam follower.
Figure 11:
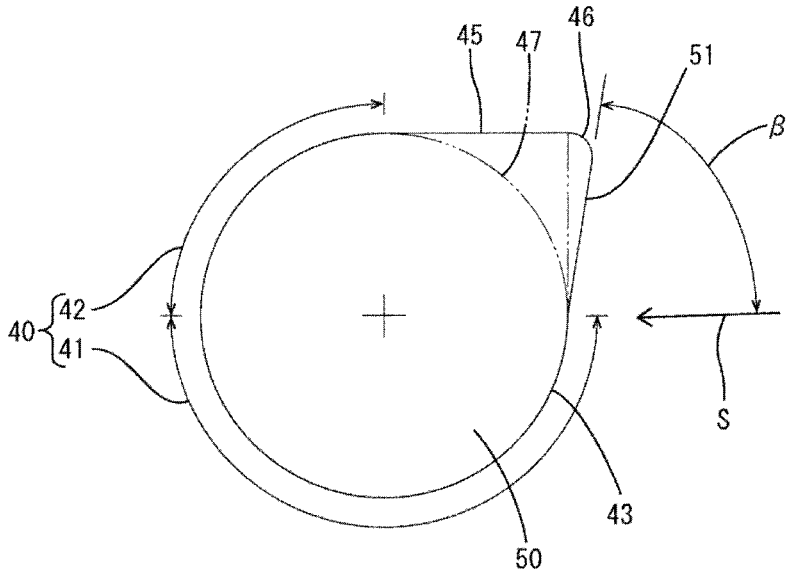
FIG. 11 is an enlarged plan view showing an outer peripheral shape of a cam follower of a second embodiment.
Figure 12:
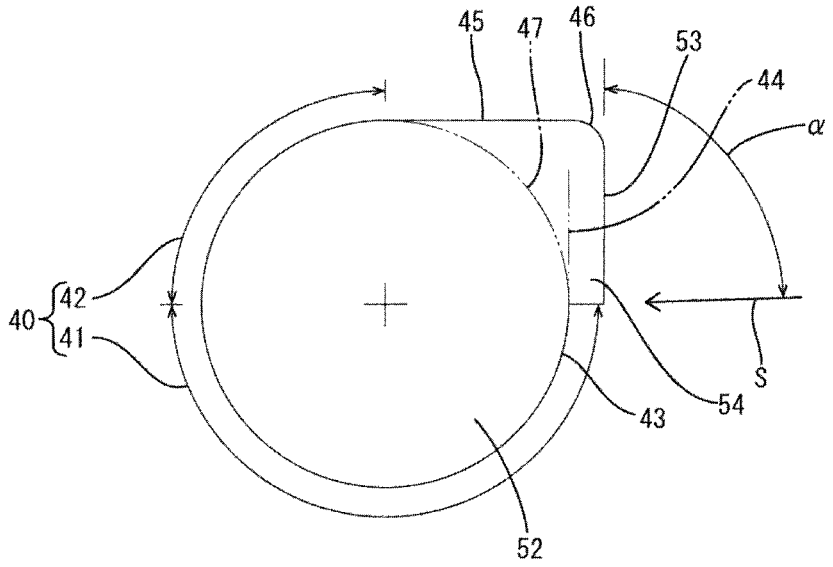
FIG. 12 is an enlarged plan view showing an outer peripheral shape of a cam follower of a third embodiment.
Figure 13:
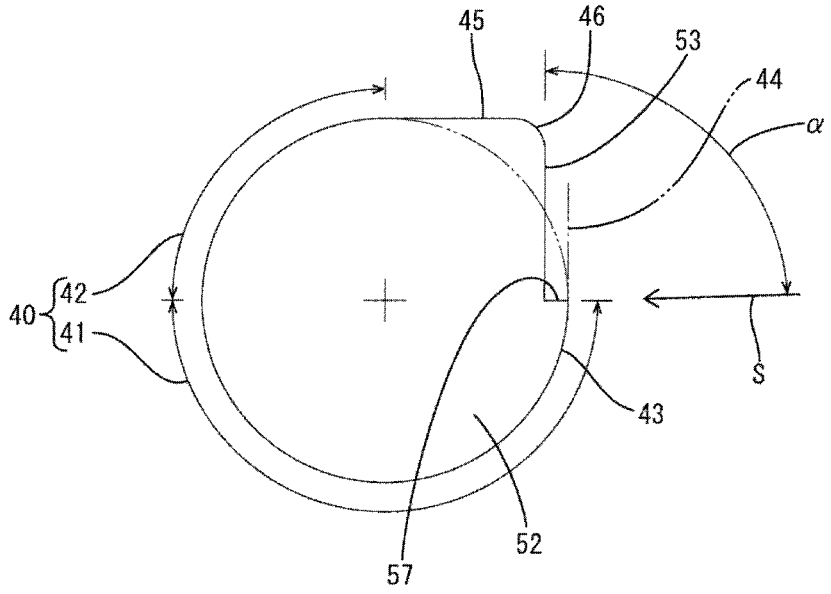
FIG. 13 is an enlarged plan view showing an outer peripheral shape of a cam follower of a fourth embodiment.
Figure 14:
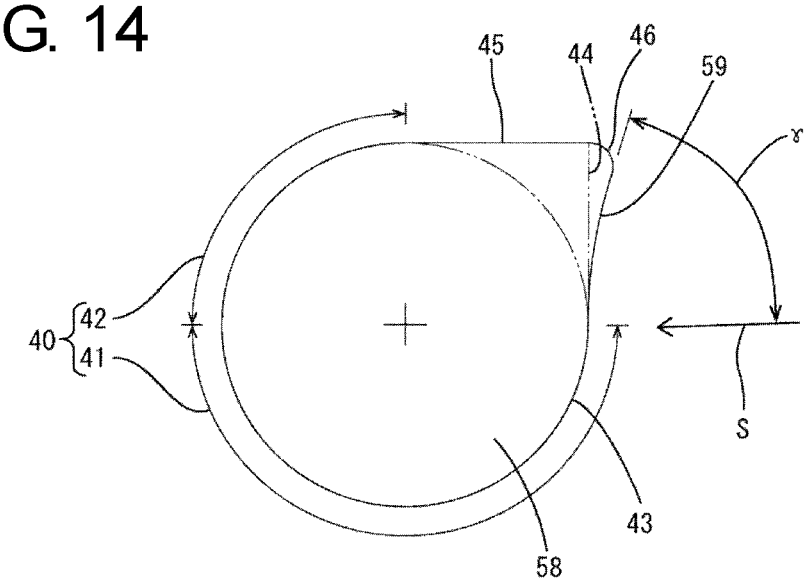
FIG. 14 is an enlarged plan view showing an outer peripheral shape of a cam follower of a fifth embodiment.

An entrance 24E of the cam groove 24 is open on a front side of the cam functioning portion 22, i.e. a side edge part facing the front surface wall 16 of the guide space 15. When the slider 21 is at or near the initial position IP, the entrance 24E of each cam groove 24 aligns substantially with the corresponding communication hole 17. As shown in FIG. 10, a contact edge 27 is defined at an edge on the initial position side of the entrance 24E of the cam groove 24 in the lateral direction (sliding direction SD of the slider 21). The front surface of the contact edge 27 defines a push-out surface 28 inclined with respect to the sliding direction SD of the slider 21. The rear surface of the contact edge part 27 constitutes a part of the connection cam surface 25 of the cam groove 24.

Figure 4:
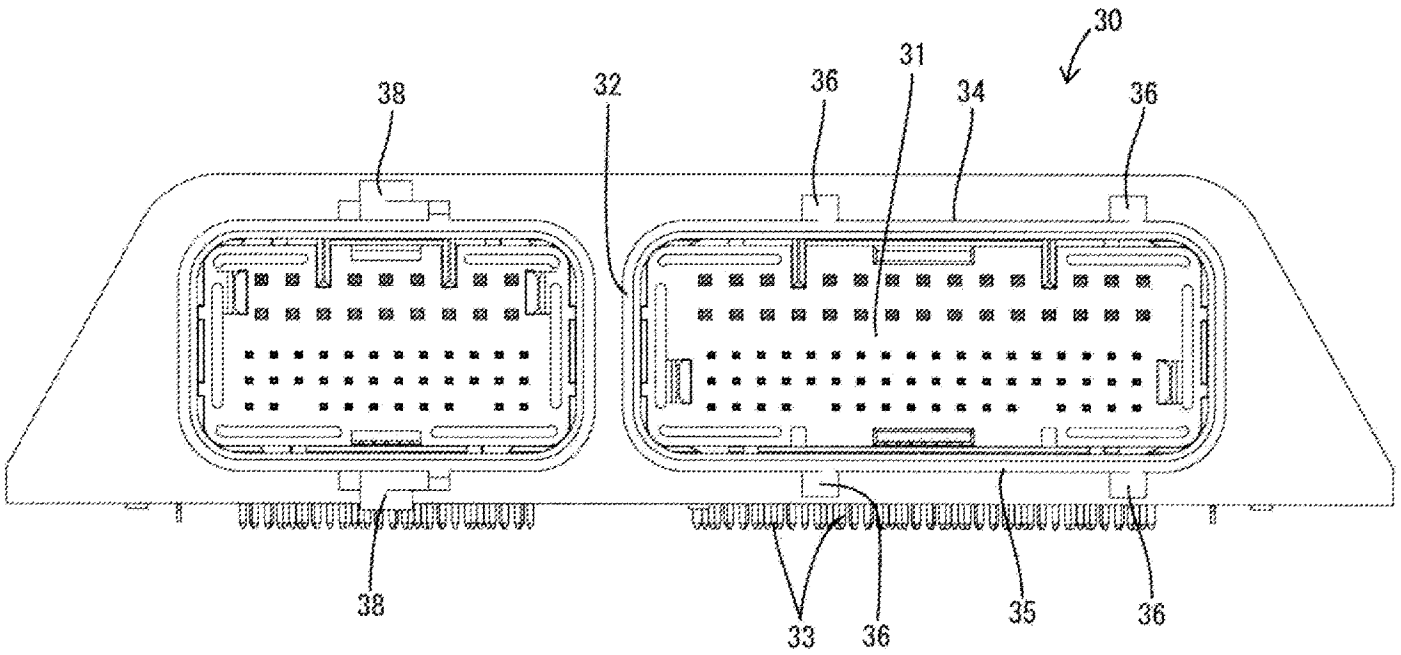
FIG. 4 is a front view of a second housing.
Figure 5:
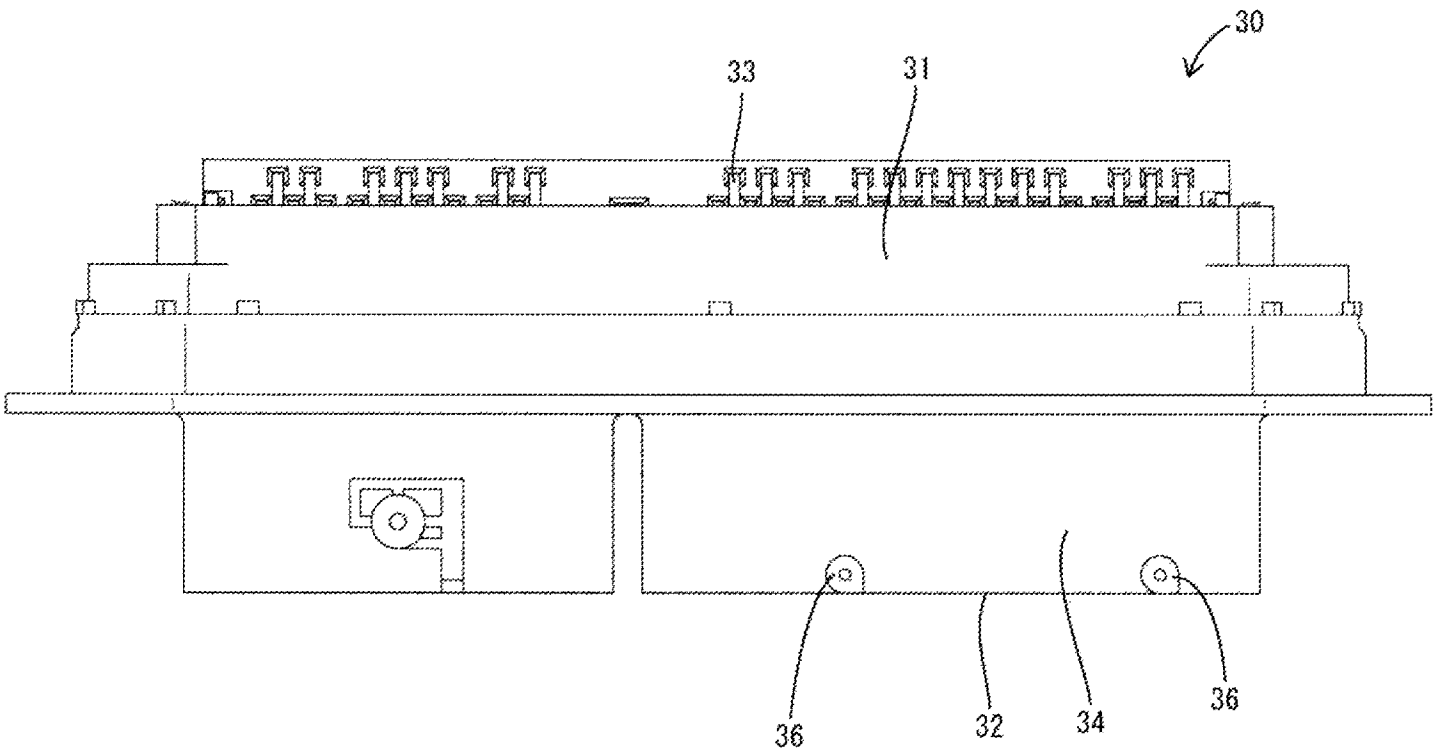
FIG. 5 is a plan view of the second housing.

The second housing 30 is made e.g. of synthetic resin. As shown in FIGS. 4 and 5, the second housing 30 is a single component including a wide terminal holding portion 31 and a receptacle 32 projecting forward from the front surface of the terminal holding portion 31. Long narrow male terminal fittings 33 are mounted in the terminal holding portion and are bent into substantially L shapes in a side view 31. A horizontal portion of each male terminal fitting 33 penetrates through the terminal holding portion 31 in a front-back direction and a front end part of the horizontal portion is located in an internal space of the receptacle 32. A downward extending vertical portion of the male terminal fitting 33 is inserted into a recess or through hole of an unillustrated circuit board.

The receptacle 32 has a wide substantially rectangular shape in a front view. When the two housings 10, 30 are connected, the receptacle 32 is fit into the fitting recess 13 and the horizontal portions of the male terminal fittings 33 and the female terminal fittings 12 are connected. Two projection-like cam followers 36 are formed on an outer surface of an upper wall 34 of the receptacle 32 while being spaced apart in the lateral direction. Further, two projection-like cam followers 36 are formed also on an outer surface of a lower wall 34 of the receptacle 32 while being spaced part in the lateral direction.

The cam followers 36 described above constitute the booster mechanism 20 and cooperate with the slider 21 to exhibit a boosting function when connecting or separating the two housings 10, 30. Note that the booster mechanism 20 of the connector of this first embodiment includes a lever 37 rotatably or pivotably mounted on the first housing 10 and cam followers 38 formed on the second housing 30 and configured to exhibit a boosting function by being fit into cam grooves (not shown) of the lever 37.

The left and right cam followers 36 formed on the upper wall 34 have the same plan view shape, and the left and right cam followers 36 formed on the lower wall 35 have the same bottom view shape. Further, the plan view shapes of the cam followers 36 on the upper wall 34 and the bottom view shape of the cam followers 36 on the lower wall 35 are vertically symmetrical.

FIG. 10 is an enlarged plan view of the cam follower 36 when viewed in a direction that substantially perpendicularly intersects both a connecting direction of the two housings 10, 30 and the sliding direction SD of the slider 21 and when viewed parallel to a projecting direction of the cam follower 36. The outer peripheral surface of the cam follower 36 comprises an arcuate cam functioning curved surface 40, a receiving surface 44, a linking surface 45 and an arcuate surface 46.

The cam functioning curved surface 40 comprises a substantially semicircular surface 41 and a substantially quarter-circular surface 42. The substantially semicircular surface 41 constitutes a substantially semicircular region of the outer peripheral surface of the cam follower 36 on a rear side (lower side in FIG. 10) in an entering direction into the cam groove 24. The substantially semicircular surface 41 has a semicircular shape having a constant curvature (i.e. constituting a part of a true circle) and extends in a range of 180° in a circumferential direction. A substantially quarter-circular region of the substantially semicircular surface 41 on a side facing the contact edge part 27 of the cam groove 24 defines a connection slide-contact surface 43. In the process of sliding the slider 21 from the initial position IP to the connection position CP, the connection slide-contact surface 43 slides in contact with the connection cam surface 25 to exhibit a boosting function.

The substantially quarter-circular surface 42 is connected to an end part (left end part in FIG. 10) not facing the contact edge part 27 of the cam groove 24 out of opposite circumferential end parts of the substantially semicircular surface 41. The substantially quarter-circular surface 42 has a quarter-circular shape having a constant curvature (i.e. constituting a part of a true circle) and extends in a range of 90° in the circumferential direction. The curvature of the substantially quarter-circular surface 42 is equal to that of the substantially semicircular surface 41 and the substantially semicircular surface 41 and the substantially quarter-circular surface 42 are continuous with each other to constitute a part of one common true circle. In the process of sliding the slider 21 from the connection position CP to the initial position IP, the substantially quarter-circular surface 42 slides in contact with the separation cam surface 26 to exhibit a boosting function.

The receiving surface 44 projects in the same direction (up in FIG. 10) as the entering direction into the cam groove 24 from an end part of the substantially semicircular surface 41 facing the contact edge 27. The receiving surface 44 is composed of a flat surface. An angle $\alpha$ between the receiving surface 44 and a virtual sliding direction line S parallel to the sliding direction SD of the slider 21 is set to be a right angle. The receiving surface 44 is tangentially and smoothly connected to the end part of the substantially semicircular surface 41.

As described above, the substantially quarter-circular surface 42 extends in the entering direction into the cam groove 24 (up in FIG. 10) from the end part of the substantially semicircular surface 41 not facing the contact edge 27. The linking surface 45 extends substantially parallel to the sliding direction SD of the slider 21 from an extending end part of the substantially quarter-circular surface 42 to an extending end part 44E of the receiving surface 44. The linking surface 45 is composed of a flat surface and at a right angle to the receiving surface 44.

An extending end part 45E of the linking surface 45 and the extending end part 44E of the receiving surface 44 are connected via the arcuate surface 46. The arcuate surface 46 is in the form of an arc having a sufficiently smaller radius of curvature than the cam functioning curved surface 40 and smoothly connected to the receiving surface 44 and the linking surface 45. Further, a region of the cam follower 36 between the receiving surface 44 and the linking surface 45 defines a projecting portion 48 projecting radially out from a virtual quarter-circular surface 47 concentric with and having the same curvature as the cam functioning curved surface 40. The outer periphery of a pointed end portion 48E (projecting end portion) of the projecting portion 48 is formed by the above arcuate surface 46.

Next, functions and effects of the first embodiment are described. In connecting the two housings 10, 30, the receptacle 32 of the second housing 30 is fit lightly into the fitting recess 13 of the first housing 10 with the slider 21 located at the initial position IP, as shown in FIG. 8. During this time, the pairs of laterally spaced cam followers 36 pass through the communication holes 17 and enter the laterally spaced entrances 24E of the cam grooves 24. With the cam followers 36 properly inserted, the connection slide-contact surfaces 43 of the cam followers 36 face the contact edges 27 of the cam grooves 24 in the lateral direction (direction intersecting the entering direction of the cam followers 36 into the cam grooves 24).

Subsequently, when the slider 21 is slid toward the connection position CP, the connection slide-contact surfaces 43 and the connection cam surfaces 25 of the cam grooves 24 slide in contact with each other to exhibit a boosting function (or force or speed increasing function) and the two housings 10, 30 are pulled toward each other. The two housings 10, 30 are connected when the slider 21 reaches the connection position CP. Further, the slider 21 is slid from the connection position CP to the initial position IP to separate the connected housings 10, 30. During this time, the substantially quarter-circular surfaces 42 of the cam followers 36 and the separation cam surfaces 26 of the cam grooves 24 slide in contact with each other to exhibit a boosting function and the two housings 10, 30 are separated.

Next, a case is described where both of the paired cam followers 36 inserted insufficiently into the entrances 24E of the cam grooves 24 in connecting the two housings 10, 30. If the both linking surfaces 45 of the paired cam followers 36 are located more outward (lower side in FIG. 10) of the cam grooves 24 than the tips of the contact edges 27 (i.e. if the projecting portions 48 are facing the push-out surfaces 28 in the lateral direction), the push-out surfaces 28 press the projecting portions 48 of the cam followers 36 as the slider 21 is slid toward the connection position CP. By this pressing action, the paired cam followers 36 are pushed out of the cam grooves 24, and the two housings 10, 30 are not connected even if the slider 21 is moved to the connection position CP.

Further, if the linking surfaces 45 of the paired cam followers 36 are located more inward of the cam grooves 24 than the tips of the contact edges 27 (i.e. if the receiving surfaces 44 are facing the contact edge parts 27 in the lateral direction), the contact edges 27 butt against the receiving surfaces 44 even if an attempt is made to slide the slider 21 toward the connection position CP. Thus, the slider 21 cannot be slid toward the connection position CP. Therefore, also in this case, the two housings 10, 30 are not connected.

Next, a case is described where the two housings 10, 30 are positioned obliquely to each other and one of the paired cam followers 36 spaced apart in the lateral direction is inserted properly in the entrance 24E of the cam groove 24, but the other cam follower 36 is inserted insufficiently in the entrance 24E of the cam groove 24 when the two housings 10, 30 are connected. As shown in FIG. 9, it is assumed that one (left one in FIG. 9) of the paired cam followers 36 is inserted properly in the entrance 24E of the cam groove 24, but the other (right one in FIG. 9) cam follower 36 is inserted insufficiently.

In this state, as shown in FIG. 10, the linking surface 45 of the insufficiently inserted cam follower 36 is located more inward of the cam groove 24 than the tip of the contact edge 27 (i.e. the receiving surface 44 is facing the contact edge 27 in the lateral direction). In this case, even if an attempt is made to slide the slider 21 toward the connection position CP, the contact edge 27 butts against the receiving surface 44 of the insufficiently inserted cam follower 36. Thus, the slider 21 cannot be slid toward the connection position CP. Therefore, the two housings 10, 30 are not connected.

As described above, the connector of this first embodiment includes the first housing 10, the second housing 30 connectable to the first housing 10 and the slider 21 provided in the first housing 10 and constituting or forming part of the booster mechanism 20. The slider 21 slides in the direction SD intersecting the connecting direction of the two housings 10, 30 between the initial position IP where the slider 21 waits when the two housings 10, 30 are not connected yet and the connection position CP where the two housings 10, 30 are brought to a properly connected state. The slider 21 is formed with the cam grooves 24 paired while being spaced apart in the sliding direction SD (lateral direction) of the slider 21. The second housing 30 is formed with the cam followers 36 paired while being spaced part in the lateral direction and constituting or forming part of the booster mechanism 20. The paired cam followers 36 individually enter the entrances 24E of one pair of cam grooves 24 with the slider 21 located at the initial position IP and the two housings 10, 30 held close to each other.

The slider 21 is formed with the contact edges 27 constituting the opening edges of the entrances 24E of the cam grooves 24 and capable of contacting the outer peripheral surfaces of the cam followers 36 in the same direction as the sliding direction SD from the initial position IP to the connection position CP. The cam follower 36 is formed with the substantially semicircular surface 41 constituting or forming part of the substantially semicircular region on the rear side of the outer peripheral surface of the cam follower 36 in the entering direction into the cam groove 24. Likewise, the cam follower 36 is formed with the receiving surface 44 constituting or forming part of the outer peripheral surface thereof and extending in the same direction as the entering direction into the cam groove 24 from the end part facing the contact edge 27 of the substantially semicircular surface 41. The receiving surface 41 is at a right angle to the sliding direction SD of the slider 21 (virtual sliding direction line S).

The technical significance of the above configuration is as follows. Specifically, if the two housings 10, 30 are inclined even slightly at the time of a connecting operation, at least one 36 of the paired cam followers 36 spaced apart in the lateral direction may not be inserted properly into the cam groove 24. If the slider 21 is slid from the initial position IP toward the connection position CP in this state, the cam follower 36 properly inserted into the cam groove 24 is guided to a back side of the cam groove 24, whereas the cam follower 36 improperly inserted into the cam groove 24 is pushed out of the cam groove 24. In this case, the second housing 30, the slider 21 and the like may be broken.

However, according to the above configuration, even if an attempt is made to slide the slider 21 from the initial position IP to the connection position CP with one cam follower 36 left improperly inserted in the entrance 24E of the cam groove 24, the contact edge part 27 butts against the receiving surface 44. Here, since the receiving surface 44 is intersecting, particularly at a steep angle such as substantially at a right angle to the sliding direction SD of the slider 21 (virtual sliding direction line S), the cam follower 36 is not pushed out of the cam groove 24 even if the contact edge part 27 strongly presses the receiving surface 44. Thus, there is no possibility that the slider 21 is slid toward the connection position CP with the one cam follower 36 pushed out of the cam groove 24, i.e. with the slider 21 and the pair of cam followers 36 held in an improper positional relationship.

Further, in the connector of this first embodiment, the receiving surface 44 is connected tangentially to the end part of the substantially semicircular surface 41. The technical significance of this configuration is as follows. If a boundary part between the substantially semicircular surface 41 and the receiving surface 44 has a complicated shape such as a stepped shape, a stress may concentrate on the boundary part between the substantially semicircular surface 41 and the receiving surface 44 when the outer peripheral surface of the cam follower 36 receives a pressing force from an inner side surface side of the cam groove 24. However, if the receiving surface 44 is connected tangentially to the end part of the substantially semicircular surface 41, a stress concentration on the boundary part between the substantially semicircular surface 41 and the receiving surface 44 can be avoided.

Further, in the connector of this first embodiment, the outer peripheral surface of the cam follower 36 has the substantially quarter-circular surface 42 extending from the end part not facing the contact edge part 27 out of the opposite circumferential end parts of the substantially semicircular surface 41 and the linking surface 45 extending substantially parallel to the sliding direction of the slider 21 from the end part of the substantially quarter-circular surface 42 toward the extending end part of the receiving surface 44. The extending end part 44E of the receiving surface 44 and the extending end part 45E of the linking surface 45 are connected via the arcuate surface 46.

The technical significance of this configuration is as follows. Since the extending end part 44E of the receiving surface 44 and the extending end part 45E of the linking surface 45 are substantially at a right angle to each other, a stress may concentrate on the pointed end portion 48E formed by the extending end part 44E of the receiving surface 44 and the extending end part 45E of the linking surface 45 (projecting end part of the projecting portion 48) when the contact edge part 27 comes into contact with the extending end part 44E of the receiving surface 44. However, since the extending end part 44E of the receiving surface 44 and the extending end part 45E of the linking surface 45 are connected via the arcuate surface 46, the concentration of a stress on the pointed end part 48E can be avoided.

Next, second to fifth specific embodiments of the present invention are described with reference to FIGS. 11 to 14. The second to fifth embodiments differ in configuration from the above first embodiment in the plan view shape (outer peripheral shape) of the cam follower 50, 52, 55, 58. The outer peripheral surface of the cam follower 50, 52, 55, 58 of the second to fifth embodiments is composed of or comprises a substantially arcuate cam functioning curved surface 40, a receiving surface 51, 53, 56, 59, a linking surface 45 and/or a substantially arcuate surface 46 similarly to the cam follower 36 of the first embodiment. Since the cam functioning curved surface 40, the linking surface 45 and the arcuate surface 46 are similar or substantially the same as in the above first embodiment, the similar or substantially same components are denoted by the same reference signs and the structures, functions and effects thereof are not described.

The receiving surface 51 of the cam follower 50 of the second embodiment is not at a right angle to the virtual sliding direction line S, but at an angle β slightly smaller than a right angle (i.e. substantially at a right angle) to the virtual sliding direction line S. That is, the receiving surface 51 of the second embodiment is inclined more toward the contact edge part 27 (not shown in FIGS. 11 to 14) than the receiving surface 44 of the first embodiment. By this angle setting, the slide of the slider 21 toward a connection position side is restricted or the cam follower 50 is pushed into the cam groove 24 by the inclination of the receiving surface 51 when the contact edge part 27 butts against the receiving surface 51.

The receiving surface 53 of the cam follower 52 of the third particular embodiment particularly substantially is a flat surface substantially at a right angle to the virtual sliding direction line S, but located radially outwardly of the receiving surface 44 of the first embodiment (closer to the contact edge part 27). A base end part of the receiving surface 53 serves as a stepped protrusion 54 projecting radially outwardly with respect to the end part of the substantially semicircular surface 41 on the side of the contact edge part 27.

The receiving surface 56 of the cam follower 55 of the fourth particular embodiment particularly substantially is a flat surface substantially at a right angle $\alpha$ to the virtual sliding direction line S, but located or displaced radially inwardly of the receiving surface 44 of the first embodiment (more distant from the contact edge part 27). A boundary part between a base end part of the receiving surface 56 and an end part of the substantially semicircular surface 41 on the side of the contact edge part 27 serves as a radially inwardly recessed stepped recess 57.

The receiving surface 59 of the cam follower 58 of the fifth particular embodiment is not at a right angle to the virtual sliding direction line S, but at an angle $\gamma$ slightly smaller than a right angle (i.e. substantially at a right angle) to the virtual sliding direction line S similarly to the receiving surface 51 of the second embodiment. Thus, the receiving surface 59 of the fifth embodiment is inclined more toward the contact edge part 27 than the receiving surface 44 of the first embodiment. Further, the receiving surface 51 of the second embodiment particularly substantially is a flat surface, whereas the receiving surface 59 of the fifth embodiment is a concavely curved surface. When the contact edge part 27 butts against the receiving surface 59 of the fifth embodiment, the cam follower 58 is pushed into the cam groove 24 by the inclination and the curved shaped of the receiving surface 59.

The invention is not limited to the above described and illustrated first to fifth embodiments. For example, the following embodiments also are included in the scope of the invention.

Although the extending end part of the receiving surface and that of the linking surface are connected via the arcuate surface in the above first to fifth embodiments, there is no limitation to this and the extending end part of the receiving surface and that of the linking surface may be connected via an angular edge part.

The cam followers are formed with the receiving surface in the above first to fifth embodiments. However, the receiving surface may be formed only on one of the cam followers.

The cam followers are shaped identically in the first to fifth embodiments, they may be shaped differently. In this case, the receiving surfaces of the both cam followers may be shaped identically or may be shaped differently.

The substantially semicircular surface is a semicircular surface having a constant curvature in the above first to fifth embodiments. However, there is no limitation to this and the substantially semicircular surface may be a substantially semicircular surface although a curvature is slightly non-uniform.

The substantially quarter-circular surface is a quarter-circular surface having a constant curvature in the above first to fifth embodiments, there is no limitation to this and the substantially quarter-circular surface may be a substantially quarter-circular surface although a curvature is slightly non-uniform.

Although the booster mechanism includes the one composed of the rotary lever and the cam followers besides the one composed of the slider and the pair of cam followers in the first to fifth embodiments, the present invention can be applied also when the booster mechanism is composed only of the slider and the pair of cam followers.

REFERENCE SIGNS

10 . . . first housing
20 . . . booster mechanism
21 . . . slider
24 . . . cam groove
24E . . . entrance of cam groove
27 . . . contact edge part
30 . . . second housing
36 . . . cam follower
41 . . . substantially semicircular surface
42 . . . substantially quarter-circular surface
44 . . . receiving surface
44E . . . extending end part of receiving surface
45 . . . linking surface
45E . . . extending end part of linking surface
46 . . . arcuate surface
50, 52, 55, 58 . . . cam follower
51, 53, 56, 59 . . . receiving surface

What is claimed is:

1. A connector, comprising:

a first housing;

a second housing connectable to the first housing;

a slider provided in or at the first housing and slidable in a direction intersecting with a connecting direction of the two housings between an initial position where the slider waits when the two housings are not connected yet and a connection position where the two housings are brought to a properly connected state;

one or more cam grooves formed on the slider;

one or more cam followers formed on the second housing and configured to individually enter one or more entrances of the one or more cam grooves with the slider located at the initial position and the two housings held proximate to each other;

at least one contact edge part constituting an opening edge part of the entrance of the cam groove and capable of coming into contact with an outer peripheral surface of the cam follower substantially in the same direction as the sliding direction from the initial position to the connection position;

a substantially semicircular surface constituting a substantially semicircular region on a rear side in an entering direction into the cam groove out of the outer peripheral surface of the cam follower; and a receiving surface constituting the outer peripheral surface of the cam follower and substantially extending in the same direction as the entering direction into the cam groove from an end part facing the contact edge part out of opposite circumferential end parts of the substantially semicircular surface;

the receiving surface being at a right angle or at an angle smaller than a right angle to the sliding direction of the slider.

2. The connector of claim 1, wherein the receiving surface is connected tangentially to the end part of the substantially semicircular surface.

3. The connector of claim 1, wherein two cam grooves are formed on the slider and are arranged at a distance from each other in a sliding direction of the slider.

4. The connector of claim 3, wherein two cam followers are formed on the second housing and are configured to individually enter entrances of the cam grooves with the slider located at the initial position and the two housings held proximate to each other.

5. The connector of claim 1, wherein the outer peripheral surface of the cam follower has a substantially quarter-circular surface extending from an end part not facing the contact edge part out of the opposite circumferential end parts of the substantially semicircular surface and a linking surface extending substantially in parallel to the sliding direction of the slider from an extending end part of the substantially quarter-circular surface to an extending end part of the receiving surface.

6. The connector of claim 5, wherein the extending end part of the receiving surface and an extending end part of the linking surface are connected via an arcuate surface.

* * * * *